US006926171B2

(12) United States Patent
Reedy et al.

(10) Patent No.: US 6,926,171 B2
(45) Date of Patent: Aug. 9, 2005

(54) PAINT COLORANT DISPENSER

(75) Inventors: Mike Reedy, Chicago, IL (US); Kenneth R. Kaufnold, Niles, IL (US); Michael Prince, Chicago, IL (US); William A. Miller, Buffalo Grove, IL (US); Robert D. Blakeman, II, Chicago, IL (US); Chris Davis, West Bend, WI (US); Dan Gremonprez, West Bend, WI (US)

(73) Assignee: Fluid Management, Inc., Wheeling, IL (US)

( * ) Notice: Subject to any disclaimer, the term of this patent is extended or adjusted under 35 U.S.C. 154(b) by 235 days.

(21) Appl. No.: 10/403,307

(22) Filed: Mar. 31, 2003

(65) Prior Publication Data

US 2004/0035882 A1 Feb. 26, 2004

Related U.S. Application Data

(60) Provisional application No. 60/371,539, filed on Apr. 10, 2002.

(51) Int. Cl.[7] ..... B44D 3/08

(52) U.S. Cl. ..... 222/108; 222/132; 222/135; 222/144.5; 141/104

(58) Field of Search ..... 222/108, 132, 222/135, 144.5, 333; 141/104, 172, 231, 275

(56) References Cited

U.S. PATENT DOCUMENTS

| | | | | | |
|---|---|---|---|---|---|
| 3,877,683 | A | * | 4/1975 | Frank et al. | 366/261 |
| 4,046,287 | A | * | 9/1977 | Hoekstra et al. | 222/309 |
| 4,323,097 | A | * | 4/1982 | Achen | 141/129 |
| 4,585,148 | A | * | 4/1986 | Ito | 222/144.5 |
| D347,646 | S | * | 6/1994 | Mayberry | D15/199 |
| 5,328,057 | A | | 7/1994 | Hellenberg et al. | |
| 5,361,812 | A | * | 11/1994 | Arneson et al. | 141/275 |
| 5,390,714 | A | | 2/1995 | North, III et al. | |
| 5,493,840 | A | * | 2/1996 | Cane | 141/104 |
| 5,542,572 | A | | 8/1996 | Davis | |
| 5,584,326 | A | * | 12/1996 | Galli | 141/104 |
| 5,697,527 | A | * | 12/1997 | Altieri et al. | 222/132 |
| 5,784,854 | A | * | 7/1998 | Mazzalveri | 141/329 |
| D472,253 | S | * | 3/2003 | Reedy et al. | D15/147 |
| 6,585,012 | B1 | * | 7/2003 | Iovino | 141/104 |
| 6,719,453 | B2 | * | 4/2004 | Cosman et al. | 366/141 |

FOREIGN PATENT DOCUMENTS

| | | |
|---|---|---|
| EP | 0283137 A1 | 9/1988 |
| EP | 0947699 A1 | 10/1999 |

* cited by examiner

*Primary Examiner*—Kenneth Bomberg
(74) *Attorney, Agent, or Firm*—Marshall, Gerstein & Borun LLP

(57) ABSTRACT

A paint colorant dispenser for dispensing colorants into both large and small containers includes a cabinet for accommodating a plurality of color and canisters in fluid communication with a common dispense outlet. A container shelf unit is disposed in front of the cabinet and below the dispense outlet. The shelf unit includes a horizontal base disposed below the dispense outlet upon which large containers can rest. The shelf unit also includes a pivoting shelf which can pivot upward and provide a horizontal resting surface closer to the dispense outlet for smaller containers. A controller, keyboard and monitor are contained in a second modular cabinet that can be disposed on either side of the first cabinet. An additional modular cabinet can be provided for accommodating additional colorant canisters. A drip containment system is disposed in the modular shelf unit.

21 Claims, 8 Drawing Sheets

PAINT COLORANT DISPENSER

CROSS-REFERENCE TO RELATED APPLICATION

This application claims the benefit under 35 U.S.C. § 119(e) of U.S. provisional patent application Ser. No. 60/371,539 filed Apr. 10, 2002, the disclosure of which is incorporated herein by reference.

TECHNICAL FIELD

A system for dispensing multiple fluids into a receptacle is disclosed. More specifically, a multiple fluid dispense system is disclosed which is modular in design, can accommodate container receptacles of at least two different sizes and includes a flexible drip containment system.

DESCRIPTION OF THE RELATED ART

Automated fluid dispensers for dispensing multiple types of fluids such as paint colorants are known. Further, such multiple fluid dispensers are often computerized or linked to a controller which controls the dispensing of the various fluids. For example, modern paint colorant dispensers often include a cabinet or housing that accommodates a plurality of colorant canisters with each canister connected to its own pump. The pumps are all linked to a controller which controls the sequence and amount of the various colorants dispensed based upon data entered through a keyboard or terminal. Such dispensers typically include a single dispense outlet and a shelf disposed under the outlet for supporting the paint can or container. While the currently available automated fluid dispensers are effective in accurately dispensing a plurality of different colorants, the designs of these dispensers suffer from common drawbacks.

For example, the dispensers are quite large due to the necessity of the cabinet housing a plurality of colorant canisters, such as eight or more and a separate pump for each canister. The bulkiness of the dispenser is exacerbated by the need to include a controller, such as a central processing unit, a keyboard and a monitor and cabinet space to house these items. Further, some dispensers must include a large number of different colorants thereby increasing the size of the cabinet that holds the canisters.

These automated paint colorant dispensers are typically utilized in the paint department of a hardware store or other retail facility. Because each store or retail facility is designed differently, many retailers are faced with the difficult task for making room for such large automated paint colorant dispensers in areas of limited space. As a result, there is a need for a more flexible design for automated paint colorant dispensers which would enable the configuration of these dispensers to be easily altered, depending upon the facility in which they are to be installed.

Further, most automated paint colorant dispensers are designed to dispense paint colorants into a large, five gallon pail or container. As a result, the shelf that supports the container is disposed vertically below the dispense outlet a sufficient distance so as to permit a five gallon container to be disposed on top of the supporting shelf but below the dispense outlet or nozzle. However, paint retailers also mix and sell paints in smaller quantities such as single gallons, quarts and pints. When a retailer needs to custom mix a smaller quantity of paint using an automated dispenser designed to dispense colorants into larger five gallon containers, a smaller container is disposed so far below the dispense outlet that splashing of the colorant as it reaches the smaller container is common and problematic. Obviously, when the colorant splashes outside of the container, the accuracy of the resulting paint color is compromised. Further, splashing of paint colorant outside of the container receptacle also results in colorant being splattered onto the dispensing apparatus causing it to be unsightly and in need of frequent clean-up. Thus, there is a need for an improved paint colorant dispenser design which enables the dispenser to easily accommodate large and small containers to thereby eliminate the splashing problem.

Finally, after the appropriate colorants are dispensed into the container, the container is then moved away from the dispense outlet, sealed and then shaken in a mechanical mixing device. However, fluid colorant often will continue to drip from the dispense outlet down onto the supporting shelf or conveyor. As a result, the colorant contaminants the shelf or conveyor, presents an unsightly appearance and requires additional clean-up. Thus, there is a need for an improved paint colorant dispenser design which addressed this dripping problem.

SUMMARY OF THE DISCLOSURE

In satisfaction of the aforenoted needs, an improved paint colorant dispenser for dispensing a plurality of colorants into both large and small containers is provided. The disclosed dispenser comprises a cabinet for accommodating a plurality of colorant canisters in fluid communication with a common dispense outlet. The dispenser further comprises a shelf unit disposed in front of the cabinet and below the dispense outlet. The shelf unit comprises a horizontal base disposed below the dispense outlet a first vertical distance sufficient to permit a large cylindrical container to be disposed on top of the base and below the dispense outlet. The shelf unit further comprises a pivoting shelf pivotally connected to the shelf unit. The pivoting shelf is movable between a first vertical position where the pivoting shelf is disposed in front of the base and a second horizontal position where the pivoting shelf is disposed above the base and below the dispense outlet. In the second horizontal position, the pivoting shelf is disposed below the dispense outlet a second vertical distance sufficient to permit a small cylindrical container to be disposed on top of the pivoting shelf and below the dispense outlet. The second vertical distance is shorter than the first vertical distance.

The top of the base of the shelf unit which accommodates the larger containers can include a plurality of rollers thereby enabling a larger, heavier filled container to be moved easily in a lateral direction away from the dispense outlet.

When rollers are disposed on top of the base of the shelf unit, a drip container may be disposed below the rollers to catch dripping colorant from the dispense outlet after the container has been removed. The rollers may be appropriately spaced so that any dripping colorant would drip down between two adjacent rollers and into the drip container. More than one drip container may be provided to ensure drip containment regardless of the placement of the shelf unit with respect to the dispense outlet.

The pivoting shelf may include a locking mechanism to secure it in the second horizontal position and prevent any accidental pivoting of the pivoting shelf when an open container is disposed thereon.

Further, a paint colorant dispenser as described above may be provided in a modular design. Specifically, a second cabinet may be provided for housing the controller, monitor and keyboard for controlling the colorants that are dispensed through the dispense outlet. This second cabinet may be disposed on either side of the first cabinet which accommodates the colorant canisters and the dispense outlet. In addition, the shelf unit may also be a separate modular construction which can be easily moved away from the front of the first cabinet thereby exposing fluid lines and pumps used to pump fluid from the canisters to the dispense outlet to facilitate maintenance and repair procedures. In addition, a third cabinet may be provided to accommodate additional colorant canisters. The third cabinet would also be modular in design and can be disposed on either side of the first cabinet or the second cabinet which accommodates the controller, monitor and keyboard.

While the disclosed embodiments are directed to paint colorant dispensing, the reader will note that all disclosed embodiments are applicable to other types of multiple fluid dispense systems.

BRIEF DESCRIPTION OF THE DRAWINGS

The disclosed dispensers are described more or less diagrammatically in the accompanying drawings wherein:

FIG. 10 is a partial perspective view of the dispensing apparatus of FIG. 1 with the pivoting shelf in an upper, horizontal position and with the rollers removed to provide a view of the drip containers.

DETAILED DESCRIPTION OF THE PRESENTLY PREFERRED EMBODIMENTS

Figure 1:
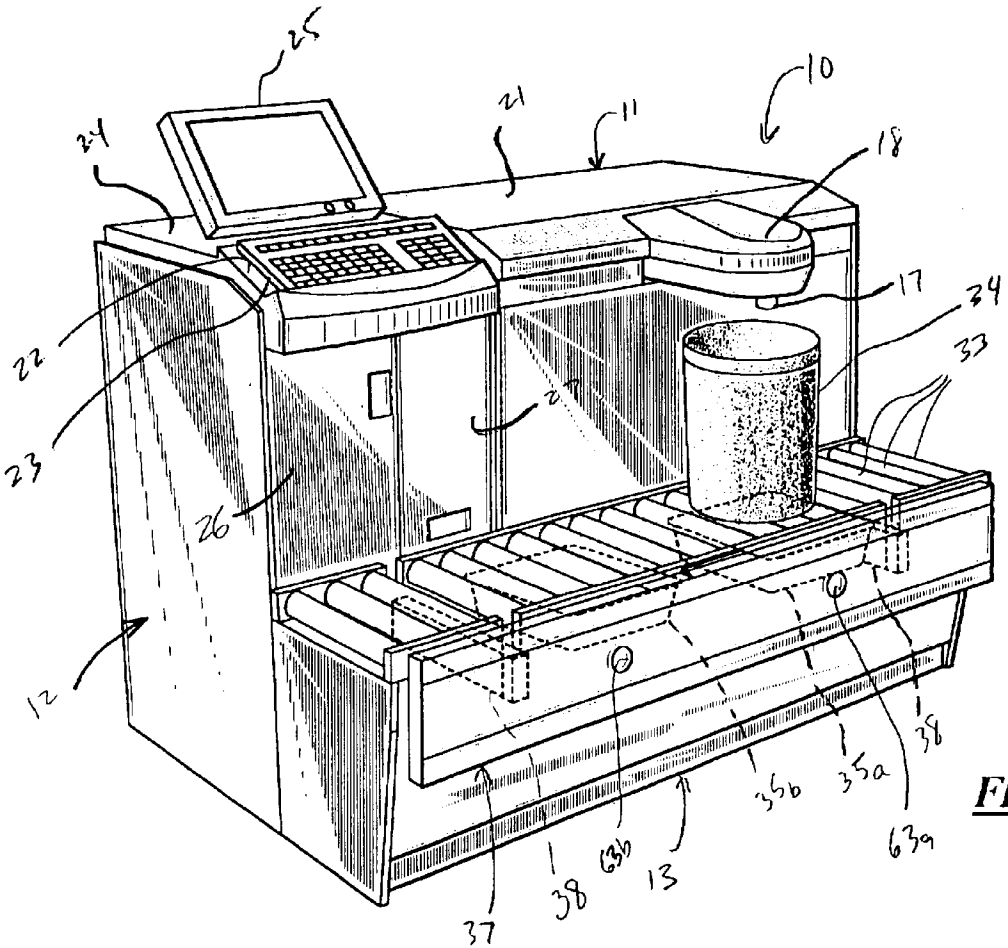
FIG. 1 is a perspective view of a disclosed paint colorant dispensing apparatus.
Figure 5:
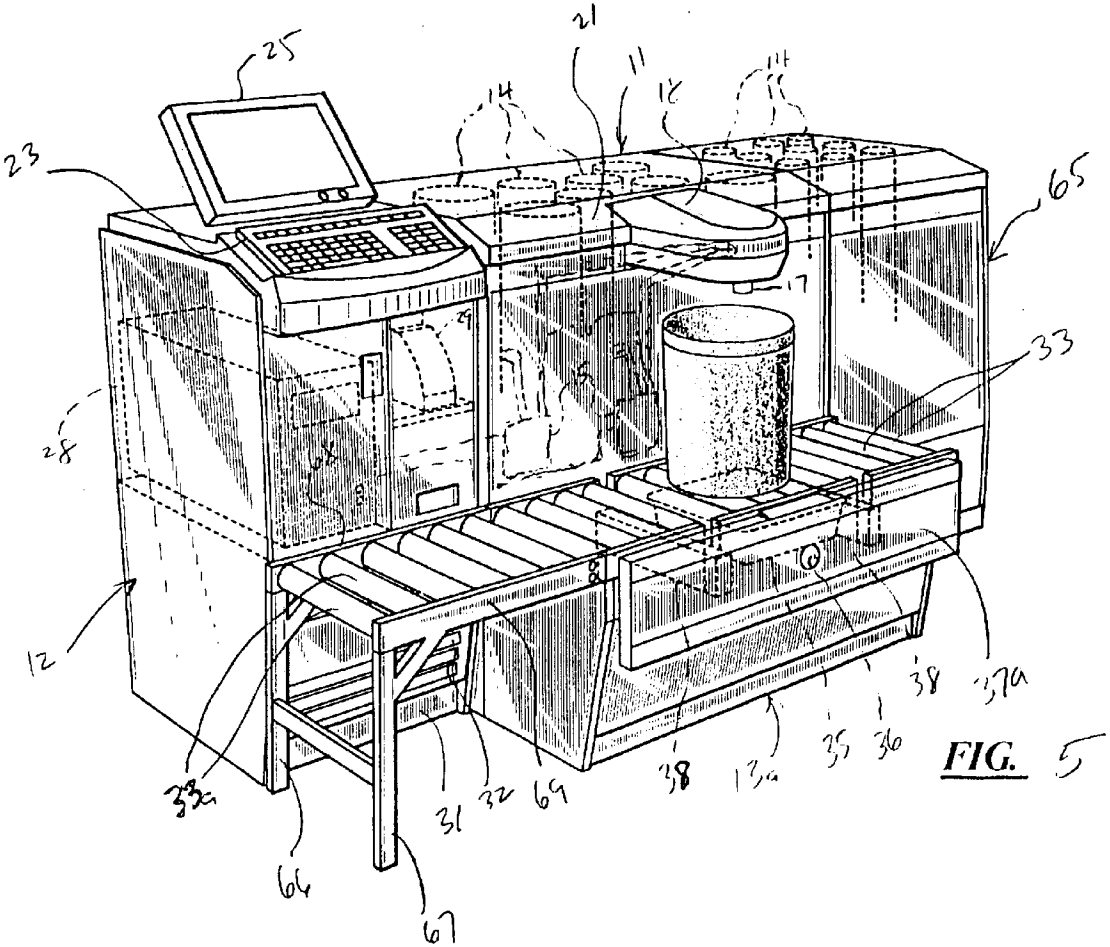
FIG. 5 is a perspective view of another disclosed paint colorant dispensing apparatus.

Turning to FIG. 1, a paint colorant dispensing apparatus 10 is illustrated which includes a first cabinet 11, a second cabinet 12 and a shelf unit 13. The first cabinet 11 accommodates a plurality of paint canisters 14, pumps 15 and fluid lines connecting the pumps 15 to the dispense outlet 17 (see, e.g, the embodiment illustrated in FIG. 5). The dispense outlet 17 is accommodated in a separate outlet housing 18 which accommodates the various fluid line 16 from the pumps 15 associated with each canister 14 and any manifolds (not shown) required to connect the various fluid line 16 to the dispense outlet 17. The first cabinet 11 includes a removable top 21 which exposes the canisters 14 (again, see FIG. 5). The second cabinet 12, includes a surface 22 for accommodating a keyboard 23 and a surface 24 for supporting a monitor 25. The second cabinet 12 also includes one or more doors 26, 27 which provide access to a controller 28, printer 29 or various supplies as illustrated in FIG. 5. Also as illustrated in FIG. 5, the cabinet 12 may include a lower panel 31 a plurality of ventilation slots 32 for maintaining air circulation and preventing overheating of the controller 28.

Figure 11:
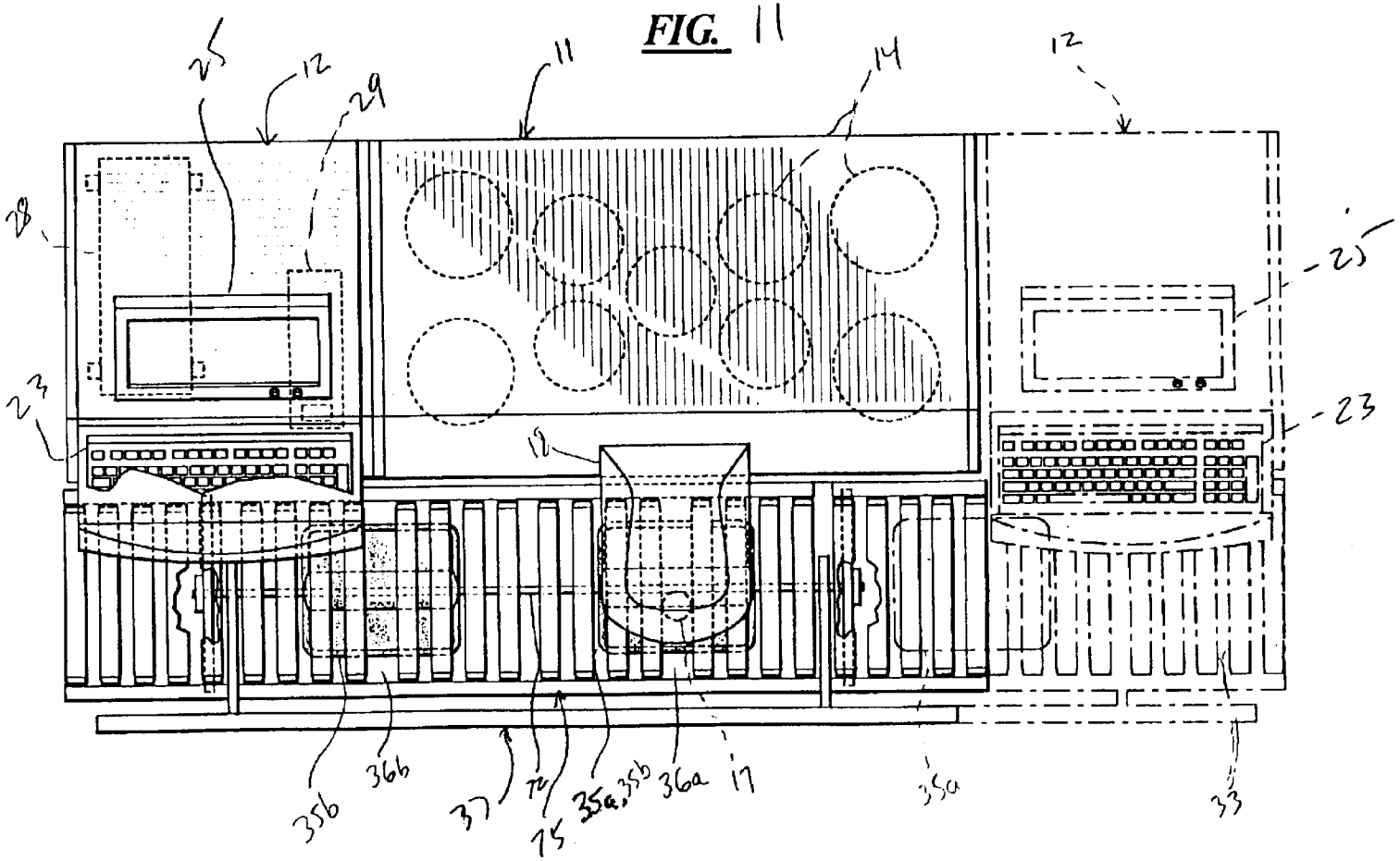
FIG. 11 is a top plan view of the dispensing apparatus of FIG. 1 further illustrating the placement of the cabinet or module housing the computer equipment on either side of the main cabinet where the colorant canisters and dispense outlet are located.

The first cabinet 11 is not fixedly connected to the second cabinet 12 and, in fact, as illustrated in FIG. 11, the second cabinet 12 may be disposed on either end of the first cabinet 11. Further, returning to FIG. 1, the shelf unit 13 is not fixedly connected to either cabinet 11 or 12 but is also modular in design. The shelf 13 includes a plurality of rollers 33 disposed vertically below the dispense outlet 17 by a sufficient amount so as to permit a large paint container 34 to be disposed on top of the rollers 13 and below the dispense outlet 17. Because custom blended paint is often sold in five gallon containers, the shelf unit 13 is preferably designed so that the rollers 33 are disposed below the dispense outlet 17 as sufficient vertical amount to accommodate a five gallon container or a large container like the one shown at 34 in FIG. 1.

Also shown in FIG. 1 are two drip containers 35*a*, 35*b*. The drip containers 35*a*, 35*b* are provided so that any colorant that drips from the dispense outlet 17 subsequent to the removal of the paint container 34 will fall from the dispense outlet 17, between two rollers 33 and into a drip container such as 35*a* as illustrated in FIG. 1. The second drip container 35*b* is provided for the configuration illustrated in phantom lines in FIG. 11. Specifically, should the end-user choose to place the second cabinet 12 on the opposite side of the first cabinet 11 as illustrated in phantom in FIG. 11, then the drip container 35*b* would be in alignment with the dispense outlet 17. Again, the space in between adjacent rollers 33 should be designed such that, in either configuration shown in phantom or in solid line in FIG. 11, a sufficient gap 36*a* or 36*b* should be provided between adjacent rollers 33 (see FIG. 11) so that colorant will drip from the dispense outlet 17, between two rollers 33 and into one of the drip containers 35*a*, 35*b*.

Figure 2:
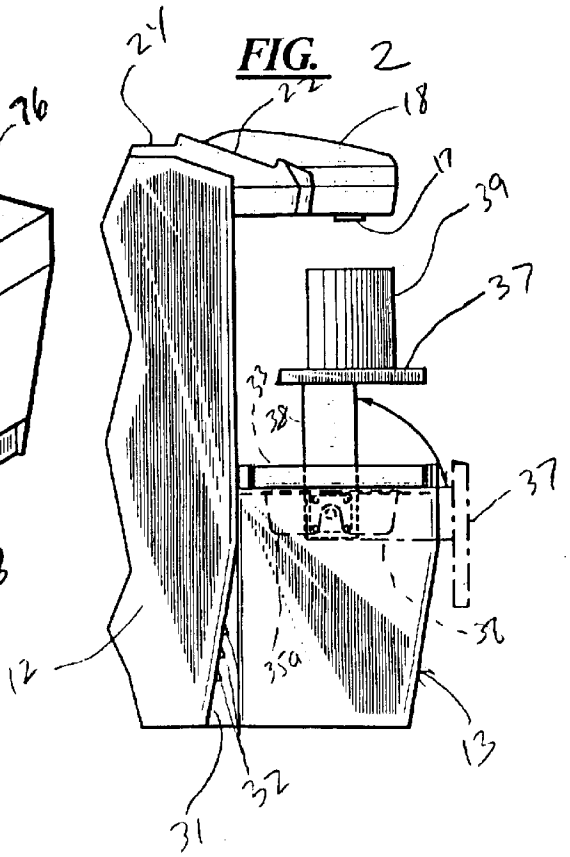
FIG. 2 is a partial side view of the dispensing apparatus of FIG. 1.
Figure 1:
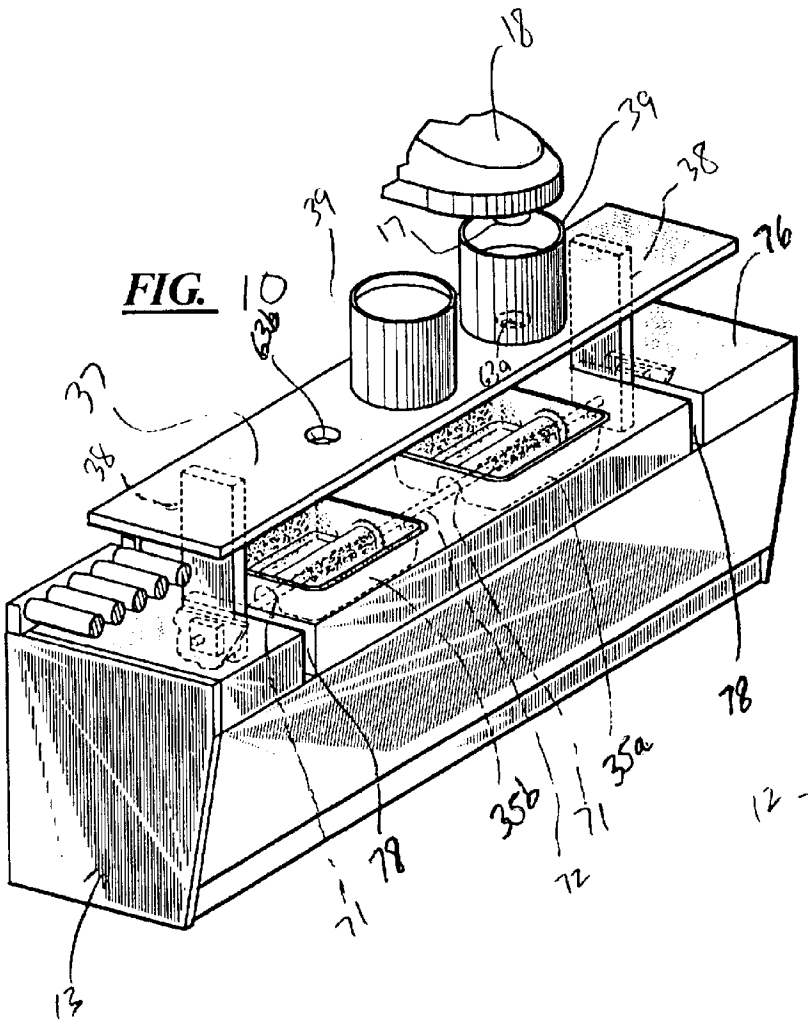

Referring now to FIGS. 1–4, the shelf unit 13 also includes a pivoting shelf 37. The pivoting shelf 37 is pivotally connected to the shelf unit 13 by support posts 38 that extend between adjacent rollers 33. As shown in FIG. 2, the shelf 37 can pivot from a first vertical position where the shelf 37 is disposed in front of the rollers 33 as shown in phantom in FIG. 2 and in solid lines in FIG. 1 to a second horizontal position shown in solid in FIG. 2. In the position shown in FIG. 2, a smaller paint container 39 may be accommodated on top of the shelf 37 and below the dispense outlet 17, but not so far below the dispenser outlet 17 such that splashing would be a common occurrence.

Figure 4:
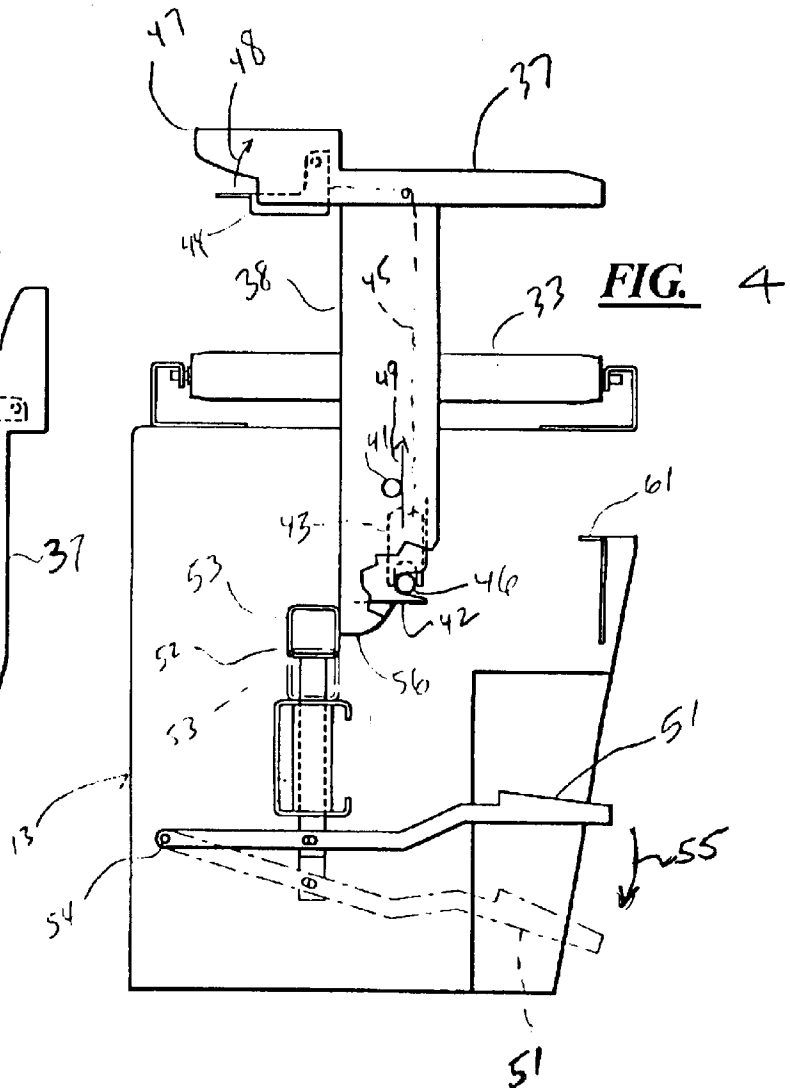
FIG. 4 is another sectional view of the shelf unit of the dispensing apparatus of FIG. 1 with the pivoting shelf in a second upper or horizontal position.
Figure 3:
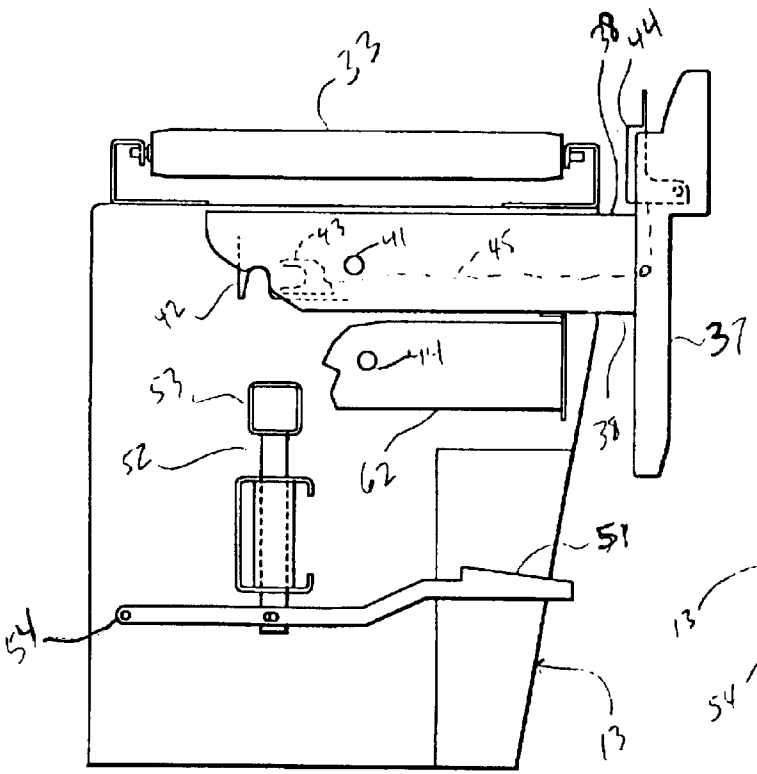
FIG. 3 is a sectional view of the shelf unit of the dispensing apparatus of FIG. 1 with the pivoting shelf in a first downward or vertical position.

Turning to FIGS. 3 and 4, the support posts 38 are pivotally connected to the shelf unit 13 by a bolt or rod 41. At least one of the support posts 38 also includes a c-shaped locking member 42. A movable latch 43 is also connected to a lever 44 by a cable 45. In the position shown in FIG. 4, the latch 43 is in a down locking position and, in combination with the locking member 42 surrounds the post 46 to secure the support post 48 and shelf 37 in the upright position shown in FIG. 4. To release the shelf 37 from the position shown in FIG. 4, the lever is pulled towards the handle 47 in the direction of the arrow 48 which causes tension to be applied to the cable 45 causing the latch 43 to move upward in the direction of the arrow 49 thereby releasing the latch 43 from the post 46.

In addition, a locking mechanism may be provided in the form the foot pedal 51. Specifically, the foot pedal 51 is connected to a vertical crossbar 52 which, in turn, is connected to a horizontal crossbar 53. The foot pedal 51 is also pivotally connected to the shelf unit 13 at the bolt 54. Depressing the foot pedal 51 in a downward direction indicated by the arrow 55 results in both the vertical crossbar 52 and horizontal crossbar 53 being moved in a downward position thereby releasing the distal end 56 of the support post 38 from engagement with the horizontal crossbar 53 which, in turn, would enable the shelf 37 to pivot downward towards the position shown in FIG. 3. In the downward position where the shelf 37 is in a vertical position (FIG. 3), the support post 38 rests on top of the lip 61 (FIG. 4) which is connected to the crossbeam 62 (FIG. 3).

Thus, in this preferred embodiment, two locking mechanisms must be activated by the user in the form of the lever 44 and foot pedal 51. Other locking mechanisms will be apparent to those skilled in the art and a single locking mechanism may be provided to save manufacturing costs. However, a dual locking mechanism is preferred to avoid an accidental release of the shelf 37 from the position shown in FIG. 4, particularly when open canisters 39 are disposed on top of the shelf 37 as shown in FIG. 10. Further, as shown in FIG. 1, the shelf 37 preferably has drip openings 63*a*, 63*b* associated with drip pans 35*a*, 35*b* as discussed above.

Turning to the embodiment illustrated in FIG. 5, a third cabinet 65 may be provided to accommodate additional colorant canisters 14. The third cabinet 65, like the first cabinet 11 and second cabinet 12, is modular in design and may be disposed on either side of the first cabinet 11. Thus, the configuration shown in FIG. 5 can be reversed. The shelf unit 13*a* shown in FIG. 5 can include an additional extending set of rollers 33*a* that are supported by a pair of legs 66, 67 and that extend between a pair of crossbeams 68, 69 that are connected to the shelf unit 13*a*. Because the shelf unit 13*a* is shorter than the shelf unit 13 illustrated in FIG. 1 and is only as long as the first cabinet 11, only a single drip container 35 in a single drip hole 36 in the shelf 37*a* is required.

Figure 6:
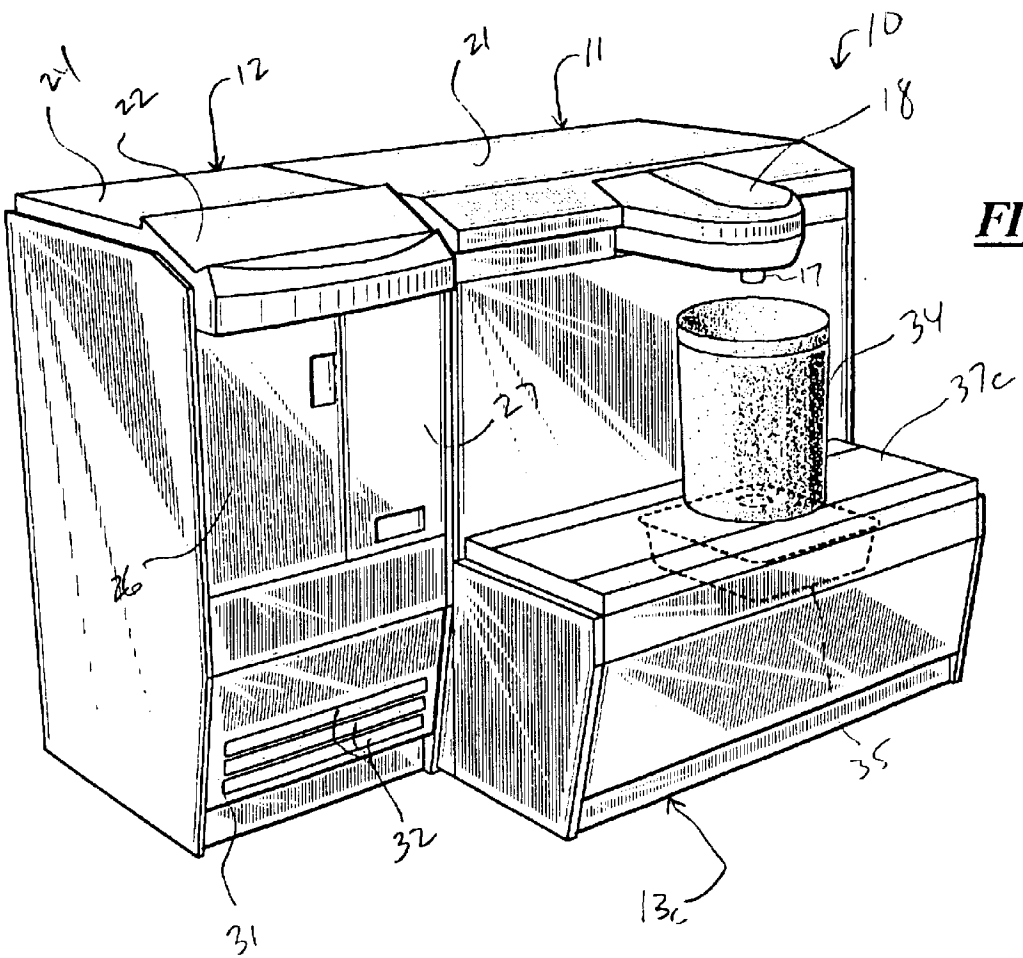
FIG. 6 is a perspective view of yet another disclosed paint colorant dispensing apparatus.
Figure 7:
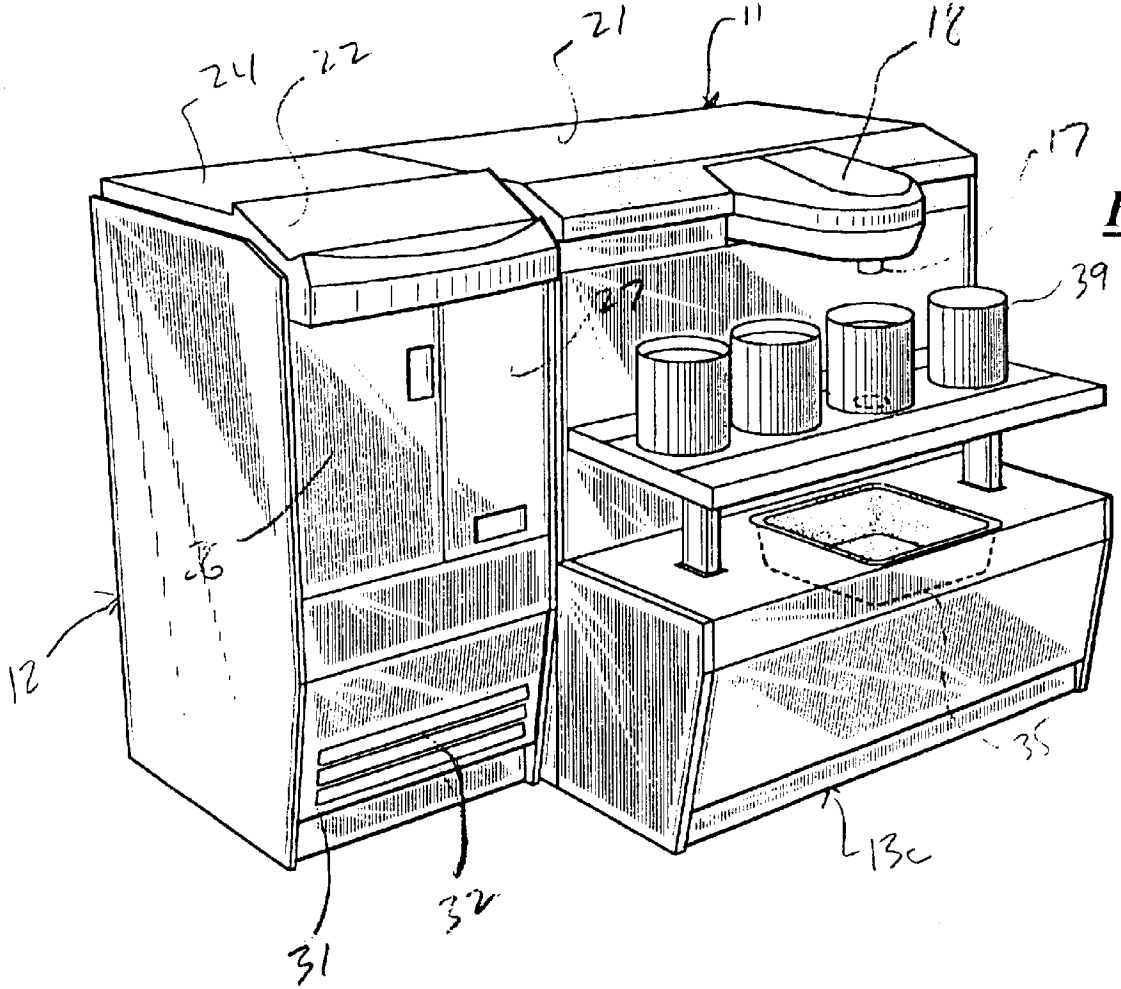
FIG. 7 is a perspective view of the dispensing apparatus of FIG. 6 with the hydraulically activated shelf in an upper or raised position.

FIGS. 6 and 7 illustrate an alternative shelf unit 13*c* which incorporates a hydraulically activated shelf 37*c*. The shelf may be raised and lowered to accommodate larger containers 34 as shown in FIG. 6 or smaller containers 39 as shown in FIG. 7. Preferably, the shelf 37*c* is hydraulically activated, however a jack arrangement or turn-crank arrangement could also be utilized. Again, only a single drip container 35 is required due to the shorter length of the shelf unit 13*c* as compared to the shelf 13 illustrated in FIG. 1.

Figures 8, 9:
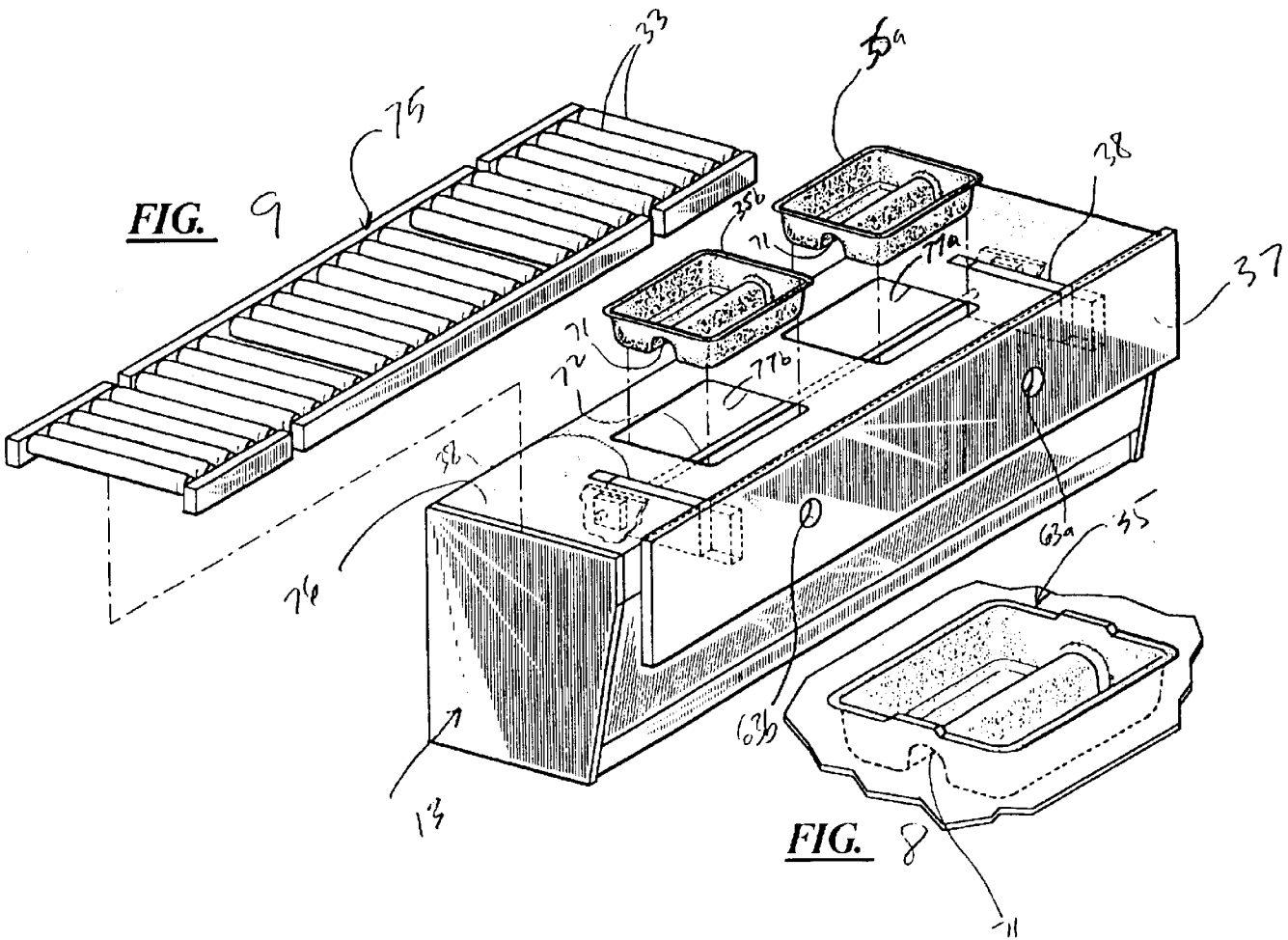
FIG. 8 is a perspective view of a drip container used with the disclosed dispensing apparatuses.
FIG. 9 is an exploded view of the shelf unit of the dispensing apparatus of FIG. 1.

Turning to FIGS. 8–10, a drip container 35 is illustrated which includes a recess 71 extending along the bottom of the container to accommodate the rod 72 that connects the support posts 38 together. To access the drip containers 35*a*, 35*b*, the roller assembly 75 is lifted off of the base surface 76 of the shelf unit 13 and the drip containers 35*a*, 35*b* may be lifted up through the apertures 77*a*, 77*b* as shown in FIG. 9. As shown in FIG. 10, the support posts 38 are accommodated in the gaps 78 in the base surface 76 of the shelf unit 13 when the shelf 37 is in the down position as shown in FIG. 8.

Thus, improved paint colorant dispensers are illustrated and described which has specific accommodations for both large and small paint containers. Further, the modular design gives the end user flexibility in placement and arrangement of the various cabinets that comprise the system. Further, an additional cabinet may be provided for additional colorants. A drip containment system is provided for the longer shelf units and provides drip containment in both possible configurations for these units. The user may stand directly in front of the keyboard when entering formulas or directions or, a longer shelf unit can be employed which extends beneath the keyboard. Even if the longer shelf unit is employed, the user still able to stand closer the keyboard than in previous designs. In any event, the user no longer has to stand directly in front of the dispense outlet. The above embodiments have applications beyond paint colorant dispensing; the disclosed dispensers may be used for numerous other multiple fluid dispensing applications.

While only certain embodiments have been set forth, alternative embodiments and various modifications will be apparent from the above description to those skilled in the art. These and other alternatives are considered equivalents within the spirit and scope of this disclosure and covered by the appended claims.

What is claimed is:

1. A fluid dispenser for dispensing multiple fluids into large containers and small containers, the dispenser comprising:

a cabinet for accommodating a plurality of colorant canisters in fluid communication with a common dispense outlet, a container shelf unit disposed in front of the cabinet and below the dispense outlet, the shelf unit comprising a horizontal base disposed below the dispense outlet a first vertical distance sufficient to permit a large cylindrical container to be disposed on top of the base and below the dispense outlet, the shelf unit further comprising a pivoting shelf pivotally connected to the shelf unit, the pivoting shelf being pivotable between a first vertical position where the pivoting shelf is disposed in front of the base and a second horizontal position where the pivoting shelf is disposed above the base and below the dispense outlet, in the second horizontal position, the pivoting shelf is disposed below the dispense outlet a second vertical distance sufficient to permit a small cylindrical container to be disposed on top of the pivoting shelf and below the dispense outlet.

2. The fluid dispenser of claim 1 further comprising a locking mechanism for releasably locking the pivoting shelf in the second horizontal position.

3. The fluid dispenser of claim 2 wherein locking mechanism comprises a handle release mechanism mounted to the pivoting shelf.

4. The fluid dispenser of claim 2 wherein locking mechanism comprises a foot release mechanism mounted on a lower portion of the shelf unit.

5. The fluid dispenser of claim 3 wherein locking mechanism comprises a foot release mechanism mounted on a lower portion of the shelf unit.

6. The fluid dispenser of claim 1 wherein the shelf unit further comprises a drip container disposed below the base and in alignment with the dispense outlet.

7. The fluid dispenser of claim 1 wherein shelf unit is not connected to the first cabinet enabling the shelf unit to be moved away from the first cabinet and the first cabinet comprises a lower opening that is exposed when the shelf unit is moved away from the front of the first cabinet.

8. The fluid dispenser of claim 1 wherein the base includes an aperture and a drip container is disposed in the shelf unit below the base and in alignment with the aperture, the aperture being in alignment with the dispense outlet.

9. The fluid dispenser of claim 8 wherein the pivoting shelf includes a drip opening when, in the second horizontal position, is in alignment with the dispense outlet, the aperture and the base and the drip container.

10. The fluid dispenser of claim 1 wherein the shelf unit further comprises a set of rollers disposed on the base and, upon which large containers can rest when the pivoting shelf is in the first vertical position.

11. A paint colorant dispenser for dispensing colorants into five gallon cylindrical containers and one gallon cylindrical containers, the dispenser comprising:

a first cabinet for accommodating a plurality of colorant canisters, each colorant canister connected to a pump, each pump in fluid communication with a common dispense outlet, each pump linked to a controller, the controller accommodated in a second cabinet disposed next to the first cabinet, a container shelf unit disposed in front of the first cabinet and below the dispense outlet, the shelf unit comprising a plurality of rollers disposed below dispense outlet a first vertical distance sufficient to permit a five gallon cylindrical container to be disposed on top of the rollers and below the dispense outlet, the shelf unit further comprising a pivoting shelf being pivotally connected to the shelf unit, the pivoting shelf being pivotable between a first vertical position where the pivoting shelf is disposed in front of the rollers and a second horizontal position where the pivoting shelf is disposed above the rollers and below the dispense outlet, in the second horizontal position, the pivoting shelf is disposed below the dispense outlet a second vertical distance sufficient to permit a one gallon cylindrical container to be disposed on top of the pivoting shelf and below the dispense outlet.

12. The paint colorant dispenser of claim 11 further comprising a locking mechanism for releasably locking the pivoting shelf in the second horizontal position.

13. The paint colorant dispenser of claim 12 wherein locking mechanism comprises a handle release mechanism mounted to the pivoting shelf.

14. The colorant paint dispenser of claim 12 wherein locking mechanism comprises a foot release mechanism mounted on a lower portion of the shelf unit.

15. The paint colorant dispenser of claim 13 wherein locking mechanism comprises a foot release mechanism mounted on a lower portion of the shelf unit.

16. The paint colorant dispenser of claim 11 wherein the shelf unit further comprises a drip container disposed below the rollers and in alignment with the dispense outlet.

17. The paint colorant dispenser of claim 11 wherein shelf unit is not connected to the first cabinet enabling the shelf unit to be moved away from the first cabinet and the first cabinet comprises a lower opening that is exposed when the shelf unit is moved away from the front of the first cabinet.

18. The paint colorant dispenser of claim 11 wherein the base includes an aperture and a drip container is disposed in the shelf unit below the base and in alignment with the aperture, the aperture being in alignment with the dispense outlet.

19. The paint colorant dispenser of claim 18 wherein the pivoting shelf includes a drip opening when, in the second horizontal position, is in alignment with the dispense outlet, the aperture and the base and the drip container.

20. The paint colorant dispenser of claim 11 further comprising a third cabinet disposed opposite the first cabinet from the second cabinet, the third cabinet accommodating a plurality of colorant canisters. Each colorant canister disposed in the third cabinet is connected to a pump also accommodated in the third cabinet, each pump accommodated in the third cabinet is in fluid communication with the dispense outlet, and each pump accommodated in the third cabinet is linked to the controller.

21. The paint colorant dispenser of claim 19 wherein the shelf unit comprises two drip containers and two apertures in the base, each aperture in alignment with one of the drip containers, the pivoting shelf includes two drip openings, each drip opening being in alignment with one of the apertures in the base and one of the drip containers, and wherein the shelf unit is not connected to the first cabinet enabling the shelf unit to be moved into a first position where one of the drip containers, aperture in the base and drip openings in the pivoting shelf are in alignment with the dispense outlet, the shelf unit further being movable to a second position where the other of the drip containers, aperture in the base and drip openings in the pivoting shelf or in alignment with the dispense outlet.

* * * * *